US010011805B2

(12) United States Patent
Ramaker et al.

(10) Patent No.: US 10,011,805 B2
(45) Date of Patent: Jul. 3, 2018

(54) CANDLE WICK AND WICK CLIP

(75) Inventors: James Ramaker, Huddleston, VA (US); Beth A. Larson, Lynchburg, VA (US); Mark A. Spangler, Bedford, VA (US)

(73) Assignee: Smith Mountain Industries, Inc., Forest, VA (US)

( * ) Notice: Subject to any disclaimer, the term of this patent is extended or adjusted under 35 U.S.C. 154(b) by 598 days.

(21) Appl. No.: 13/325,167

(22) Filed: Dec. 14, 2011

(65) Prior Publication Data

US 2012/0148966 A1 Jun. 14, 2012

Related U.S. Application Data

(60) Provisional application No. 61/499,951, filed on Jun. 22, 2011, provisional application No. 61/488,439, filed on May 20, 2011, provisional application No. 61/423,877, filed on Dec. 16, 2010, provisional application No. 61/422,716, filed on Dec. 14, 2010.

(51) Int. Cl.

| | |
|---|---|
| ***C11C 5/00*** | (2006.01) |
| ***F23D 3/16*** | (2006.01) |
| ***F23D 3/18*** | (2006.01) |

(52) U.S. Cl.

CPC ..... *C11C 5/006* (2013.01); *F23D 3/16* (2013.01); *F23D 3/18* (2013.01); *F23D 2900/03082* (2013.01); *Y10T 24/44* (2015.01)

(58) Field of Classification Search

CPC .... F23D 2900/03082; F23D 3/16; F23D 3/18; C11C 5/006; Y10T 24/44

USPC ..... 431/292, 325, 288, 290, 291, 297, 301, 431/310; 264/271.1; D26/9

See application file for complete search history.

(56) References Cited

U.S. PATENT DOCUMENTS

| | | | | |
|---|---|---|---|---|
| 1,267,968 | A * | 5/1918 | Bulle | 431/291 |
| 2,168,698 | A * | 8/1939 | Bunt et al. | 431/291 |
| 2,240,071 | A * | 4/1941 | Gisolfi | 431/291 |
| 2,291,067 | A * | 7/1942 | Atkins | 431/291 |

(Continued)

FOREIGN PATENT DOCUMENTS

| | | |
|---|---|---|
| CN | 86209496 U | 12/1987 |
| CN | 1269396 A | 10/2000 |

(Continued)

OTHER PUBLICATIONS

Australian Office Action dated Feb. 6, 2015 for Application No. AU 2011343841, 3 pgs.

Australian Office Action dated Dec. 3, 2015 for Application No. AU 2011343841, 4 pgs.

Australian Office Action dated Jan. 12, 2016 for Application No. AU 2011343841, 4 pgs.

(Continued)

*Primary Examiner* — Alissa Tompkins
*Assistant Examiner* — Benjamin W Johnson
(74) *Attorney, Agent, or Firm* — Husch Blackwell LLP

(57) ABSTRACT

A candle wick includes a first portion oriented perpendicular to a second portion to form a candle wick with a plus-shaped configuration. A wick clip includes a first slot oriented perpendicular to a second slot to form a wick clip plus-shaped configuration sized to receive the plus-shaped configuration of the candle wick. The first slot of the wick clip is configured to receive the first portion of the candle wick, and the second slot of the wick clip is configured to receive the second portion of the candle wick. The candle wick and wick clip form a clip assembly. A candle comprises a plus-shaped candle wick held in place by a wick clip.

8 Claims, 18 Drawing Sheets

(56) References Cited

U.S. PATENT DOCUMENTS

| | | | | |
|---|---|---|---|---|
| 3,036,451 | A * | 5/1962 | Miller | 102/336 |
| 3,269,807 | A * | 8/1966 | Key, Jr. | 44/519 |
| 3,730,674 | A | 5/1973 | Gross | |
| 4,194,675 | A | 3/1980 | Peters, Jr. | |
| 4,835,663 | A * | 5/1989 | Abbott et al. | 362/159 |
| D643,554 | S | 8/2011 | Decker | |
| 8,216,322 | B2 | 7/2012 | Schweickhardt | |
| 8,348,662 | B2 | 1/2013 | Decker | |
| 2004/0009447 | A1 | 1/2004 | Decker | |
| 2005/0037308 | A1* | 2/2005 | Decker | 431/325 |

FOREIGN PATENT DOCUMENTS

| | | | |
|---|---|---|---|
| CN | 1507508 | A | 6/2004 |
| CN | 103298919 | A | 9/2013 |
| DE | 20 2005 017961 | U1 | 3/2006 |
| EP | 2652103 | B1 | 3/2015 |
| WO | WO 2005/076770 | A2 | 8/2005 |

OTHER PUBLICATIONS

Chinese Office Action dated Mar. 5, 2014 for Application No. CN 201180060544.1, 21 pgs.
Chinese Office Action dated Nov. 3, 2014 for Application No. CN 201180060544.1, 6 pgs.
International Search Report and Written Opinion dated Mar. 28, 2012 for Application No. PCT/US2011/064887, 7 pgs.
Mexican Office Action dated Sep. 11, 2015 for Application No. MX/a/2013/006773, 12 pgs.
Mexican Office Action dated Mar. 16, 2016 for Application No. MX/a/2013/006773, 12 pgs.
Vietnamese Office Action dated Feb. 14, 2015 for Application No. VN 1-2013-01791, 2 pgs.
Australian Office Action dated Jul. 25, 2016 for Application No. AU 2016200685, 3 pgs.
Mexican Office Action dated Dec. 8, 2016 for Application No. MX/a/2013/006773, 4 pgs.
Mexican Office Action dated Mar. 5, 2015 for Application No. MX/a/2013/006773.

* cited by examiner

CANDLE WICK AND WICK CLIP

PRIORITY

This application claims priority to U.S. Provisional Patent Application Ser. No. 61/422,716, filed Dec. 14, 2010, entitled "WOOD WICK CONFIGURATION," U.S. Provisional Patent Application Ser. No. 61/423,877, filed Dec. 16, 2010, entitled "WOOD WICK CONFIGURATION," U.S. Provisional Patent Application Ser. No. 61/488,439, filed May 20, 2011, entitled "CANDLE WICK," and U.S. Provisional Patent Application Ser. No. 61/499,951, filed Jun. 22, 2011, entitled "CANDLE WICK," the disclosures of which are incorporated by reference herein.

BACKGROUND

A candle wick conducts fuel, such as melted candle wax, to a candle flame. It can be made of absorbent materials or materials with sufficient capillary action. The fuel vaporizes and combusts when it reaches the candle flame via the wick, allowing the candle to continue burning. The wick and its characteristics influence how the candle burns. The present invention relates to a candle wick of a particularly advantageous configuration.

BRIEF DESCRIPTION OF THE DRAWINGS

While the specification concludes with claims which particularly point out and distinctly claim the invention, it is believed the present disclosure will be better understood from the following description of certain examples taken in conjunction with the accompanying drawings, in which like reference numerals identify the same elements and in which:

Figure 1:
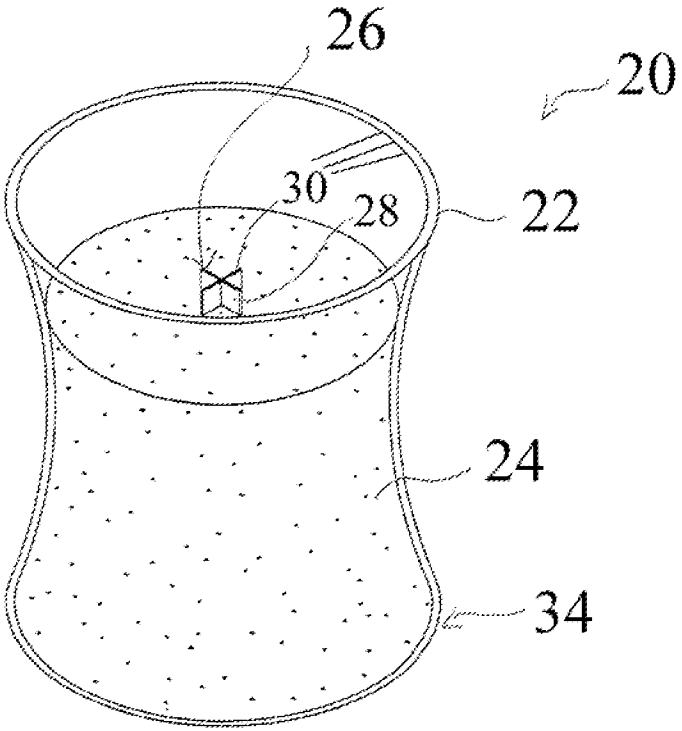
FIG. 1 depicts a perspective view of a candle jar filled with candle wax surrounding an exemplary candle wick according to an embodiment of the present disclosure.

The drawings are not intended to be limiting in any way, and it is contemplated that various embodiments of the present disclosure may be carried out in a variety of other ways, including those not necessarily depicted in the drawings. The accompanying drawings incorporated in and forming a part of the specification illustrate several aspects of the present disclosure, and together with the description serve to explain the principles of the present disclosure; it being understood, however, that this disclosure is not limited to the precise arrangements shown.

DETAILED DESCRIPTION

A candle wick according to an embodiment of the present invention includes a first portion and a second portion oriented approximately perpendicularly with respect to the first portion to form a substantially cross or plus-shaped configuration. The first and second portions are each generally flat or planar. The first portion and the second portion may comprise a single unit such that the first and second portions form a single wick piece. For example, the candle wick may be extruded, machined, braided, or otherwise formed from a suitable material known to one of ordinary skill in the art in view of the teachings herein to form a single, monolithic piece. Each of the first and second portions may include a rear section and a front section. Thus, the monolithic candle wick includes a total of four sections interlocking at a center portion, for example, to form a plus-shaped configuration. Alternatively, and as described below, the first portion and the second portion may be formed from two or more separate units that are assembled to form the candle wick. The first portion in such a configuration may form a first piece or arm, and the second portion may form a second piece or arm.

Each of the first portion and the second portion of the candle wick includes a length. The length of the first portion may be substantially equal to the length of the second portion. Further, each portion may be comprised of a suitable, generally self supporting material capable of absorbing fuel and/or having sufficient capillary action, in either case to deliver fuel to a flame. Such materials are known in the art and may include, for example, wood, cardboard, or a braided or knitted glass or fiber, such as cotton. The first and second portions are typically comprised of the same material, but that is not required. For example, the first and/or second portions of the candle wick may be comprised of a substantially straight grained solid wood such as pine, southern maple, maple, and/or cherry maple.

A wick clip holds a wick in place during manufacture of the candle. It also is a safety device that provides a barrier between whatever is beneath the candle (such as a jar or other holder) and the flame. In addition, it holds the end of the wick above a pool of melted wax. The present candle wick can be used with any wick clip that will provide these features.

A wick clip according to an embodiment of the present invention is configured to receive the plus-shaped configuration of the candle wick. The wick clip advantageously supports the candle wick in an upright manner such that candle wick may remain in an upright position when inserted in a container such as a candle jar, as described below. The wick clip further advantageously provides a safer assembled candle, as the wick clip substantially prevents the candle wick from touching a container surface, such as a bottom surface of the container into which the clip assembly is received. As another safety feature, the wick clip advantageously holds the wick above and out of the candle fuel at the end of the candle's life.

The present candle wick can be used in any candle configuration. For example, it can be used in a free-standing candle or in a candle contained within a receiving container. The receiving container may be, for example, a candle jar. The jar may be made of glass or any other suitable material. The jar may be configured to contain a candle fuel, such as wax.

An underside of the wick clip is attachable and securable to an upper surface of a receiving container. The wick clip may be attached to the container via any suitable manner as known to one of ordinary skill in the art in view of the teachings herein. The wick clip may be attached to the container via an adhesive, as described below. The wick clip may first be attached to the container and then may receive the first and second arms of the candle wick. Alternatively, the wick clip and candle wick may first be engaged to form the clip assembly, and the undersurface of the wick clip may then be attached to the container.

After the clip assembly is secured in the container such that the wick clip stands substantially upright, such fuel may be poured into the container. For example, hot wax may be poured into a candle jar about the clip assembly and up until a level just below a top portion of the candle wick. The hot wax may then cool about the clip assembly, as described further below with respect to the Figures.

Figure 2:
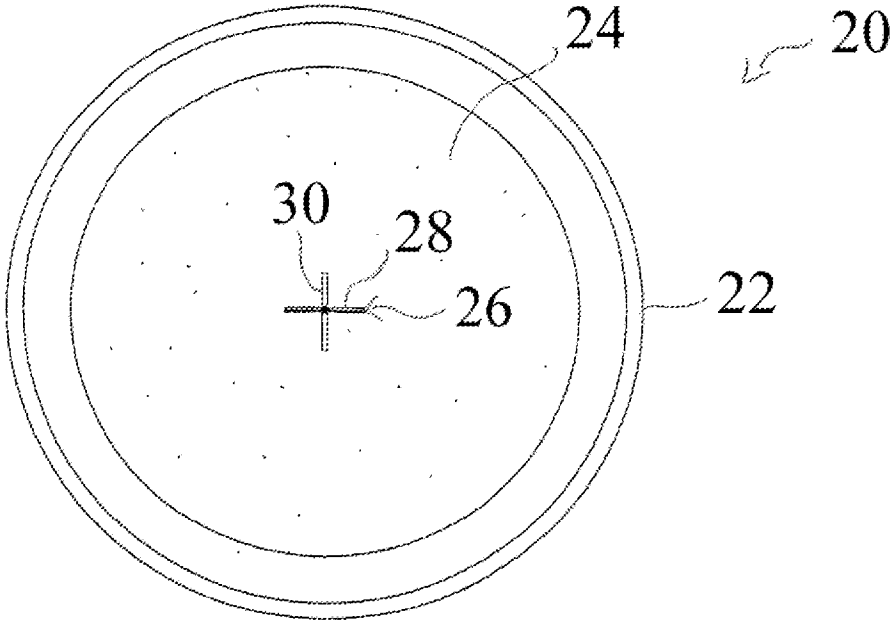
FIG. 2 depicts a top plan view of the candle jar, candle wax, and candle wick of FIG. 1.
Figure 3:
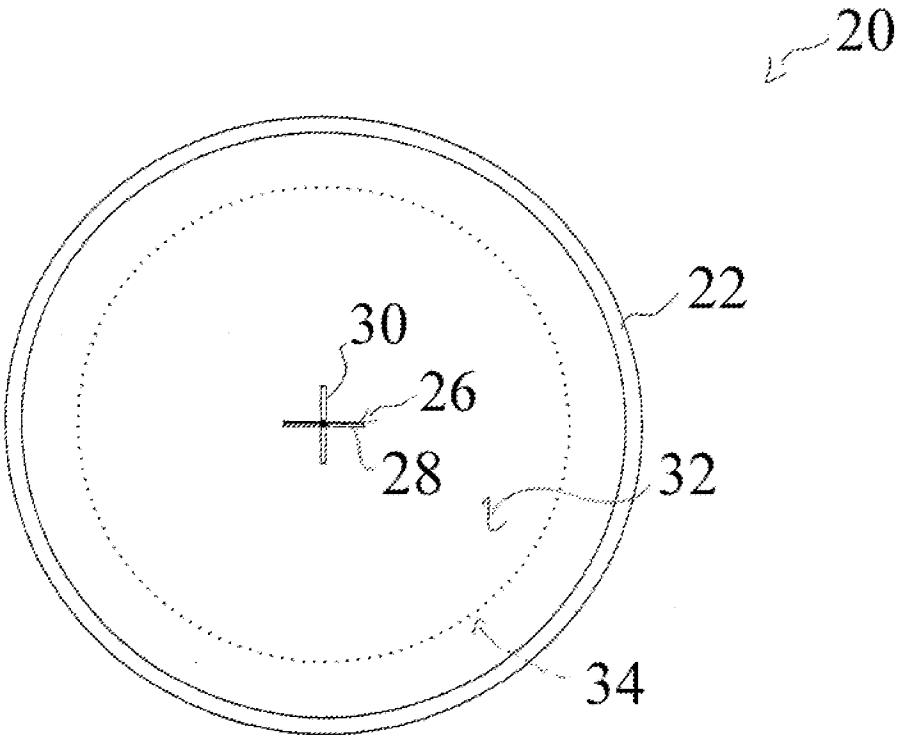
FIG. 3 depicts a top plan view of the candle jar and candle wick of FIG. 1, where the candle wax is not shown.

FIG. 1 illustrates exemplary candle (20) including candle jar (22), which houses candle wax (24) and one embodiment of candle wick (26). Candle wick (26) is surrounded by candle wax (24). FIG. 2 shows a top plan view of candle wick (26) surrounded by candle wax (24), which is contained in candle jar (22). FIG. 3 shows a top plan view of candle wick (26) disposed in candle jar (22) where candle wax (24) is not shown. Candle wick (26) is disposed on upper surface (32) of bottom portion (34) of candle jar (22).

Candle wick (26) comprises wick pieces (28, 30). Each of wick pieces (28, 30) is of approximately the same length as the other of wick pieces (28, 30), and each wick piece (28, 30) is approximately equal to the length of the candle. Further, each wick piece (28, 30) is generally flat and made to intersect and interlock with the other wick piece (28, 30) to form a symmetrical plus or cross shape in a first embodiment of the present disclosure. As shown in FIG. 3, wick pieces (28, 30) are interlocked in a plus-shaped configuration. Wick pieces (28, 30) are further shown as symmetric pieces each having the same shape, width, and length.

Additionally or alternatively, the positioning of the point at which wick pieces (28, 30) interlock may be changed to an off-center location along one or both wick pieces. Further, wick pieces (28, 30) may be asymmetric in that they each have the same length but each has a different width.

Figure 6:
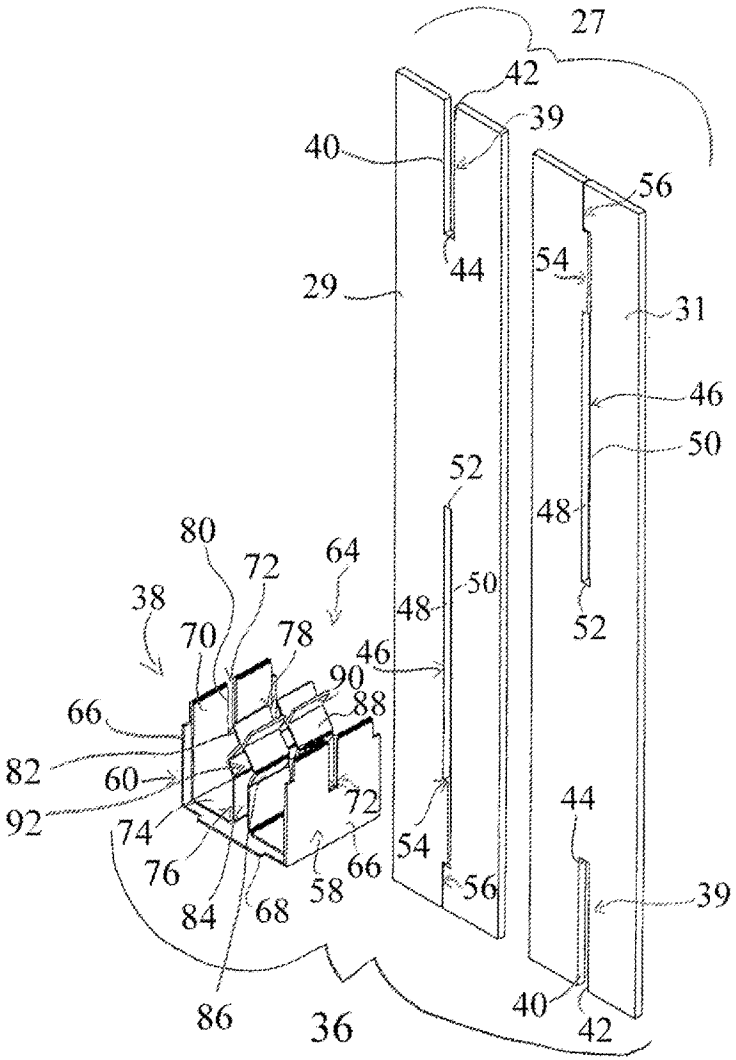
FIG. 6 depicts a perspective view of a wick clip and candle wick of an embodiment of the present invention before assembly.

FIG. 6 shows another embodiment of a candle wick (27) that includes wick pieces (29, 31) each including, at a first end, first slot (39) defined by elongate walls (40, 42) and connecting wall (44) disposed therebetween. Wick pieces, and slots within the wick pieces, can be cut from sheets of material using processes known in the art, such as laser cutting, die cutting, water jet, milling, braiding, or injection molding. At a second, opposite end, wick pieces (29, 31) include second slot (46) defined by elongate walls (48, 50) and connecting wall (52) disposed therebetween. Elongate wall (48) includes protrusion (54) and elongate wall (50) includes protrusion (56). Protrusion (54) is sized to rest above protrusion (56) within second slot (46). Protrusion (54) may be spaced away from protrusion (56) when wick pieces (29, 31) are initially joined, as described further below. The length of first slot (39) of one of wick pieces (29, 31) is sufficient to receive and engage protrusions (54, 56) of the other of wick pieces (29, 31). First slot (39) extends a length that is less than a third of the total length of either wick piece (28, 30).

When making a multi-piece candle wick, one can use any suitable shapes for such wick pieces (29, 31) that generally intersect so as to form a generally plus or cross shaped configuration. Additional configurations would be apparent to those of skill in the art in view of the teachings herein and are within the scope of the present disclosure. For example, the edges of wick pieces (29, 31) may be serrated or rounded rather than flat. Additionally or alternatively, wick pieces (29, 31) may have a shape other than a substantially rectangular shape. The ratio of wick piece sides may be adjusted to change an associated flame height in a manner apparent to one of ordinary skill in the art in view of the teachings herein.

Figure 19:
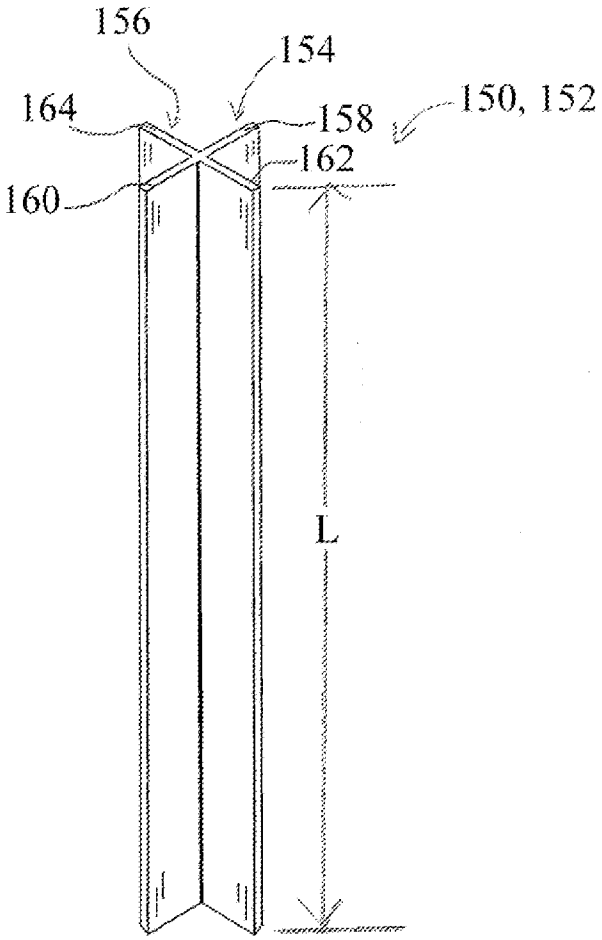
FIG. 19 depicts a perspective view of an alternative embodiment of a candle wick.
Figure 21:
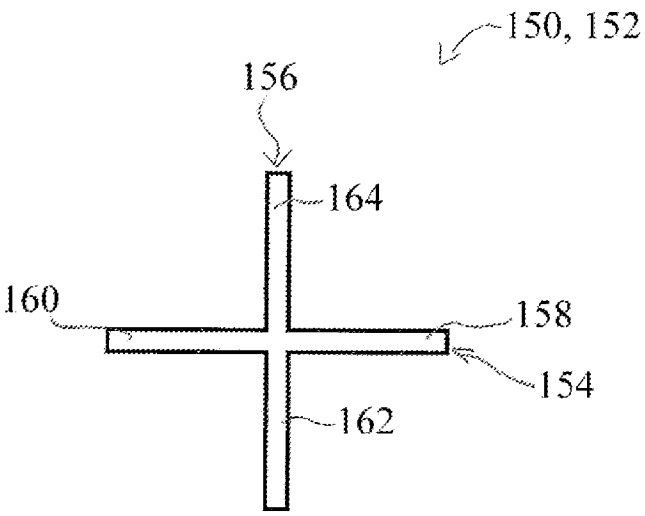
FIG. 21 depicts a top plan view of the candle wick of FIG. 19.
Figure 20:
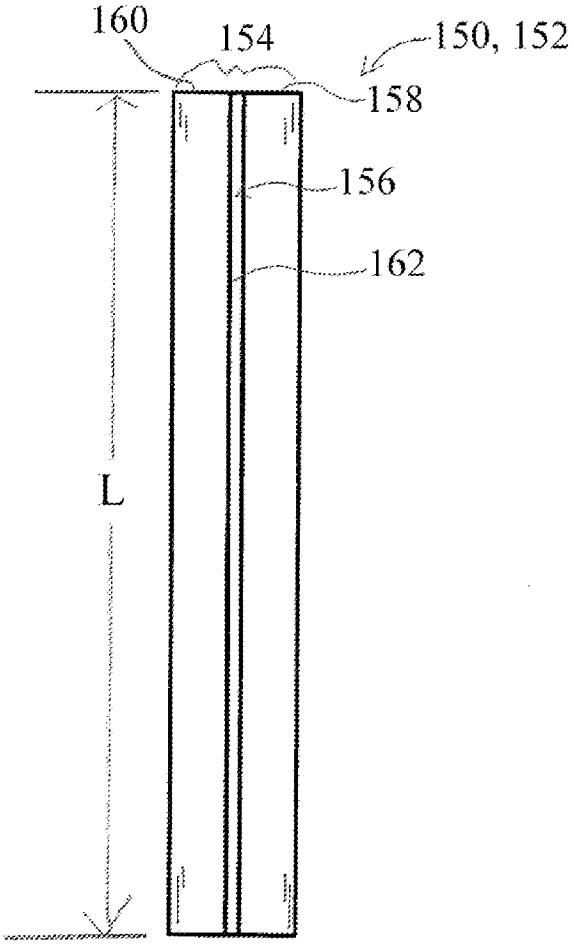
FIG. 20 depicts a side elevation view of the candle wick of FIG. 19.

FIGS. 19-20 show another embodiment of a candle wick (150) that includes a single wick piece (152). Wick piece (152) is a single piece that may be formed from, for example, extrusion or machining processes. Wick piece (152) includes first portion (154) and second portion (156). Each of first portion (154) and second portion (156) include a length (L), which is shown as substantially the same length but may be a different length for each portion (154, 156). First portion (154) includes front section (158) and rear section (160). Second portion (156) includes front section (162) and rear section (164). Second portion (156) is oriented perpendicular to first portion (154) to form a generally plus-shaped configuration.

Referring back to FIG. 6, an embodiment of wick clip (38) includes front portion (58), rear portion (60), and side portions (64) disposed therebetween. Each of front portion (58) and rear portion (60) include exterior vertical walls (66) with connecting, bottom horizontal wall (68) disposed therebetween. Exterior vertical walls (66) each abut and/or attach to interior vertical walls (70). Slot (72) is defined in each interior vertical wall (70) by a pair of elongate walls (80) extending from an upper portion of each interior vertical wall (70) to a middle portion, at which point the pair of elongate walls (80) are connected by a horizontal connecting wall (82) disposed therebetween.

Figure 7:
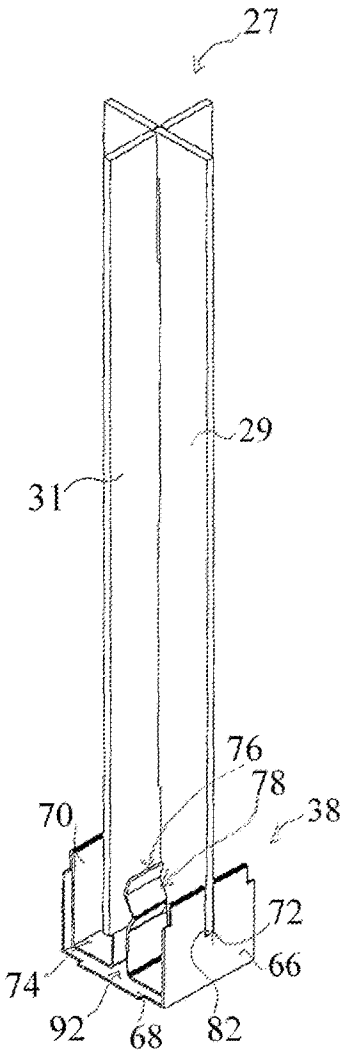
FIG. 7 depicts a perspective view of the wick clip and candle wick of FIG. 6.

Interior horizontal walls (74) are positioned at bottom portions of interior vertical walls (70). Each interior horizontal wall (74) is disposed above and/or abuts bottom horizontal wall (68). Interior horizontal walls (74) attach to vertically projecting central walls (76), each of which comprise a central slot (78) defined within an intermediate portion of a respective vertically projecting central wall (76). Vertical bottom wall (84) may define a portion of central slot (78), or central slot (78) may have a bottom horizontal wall (not shown) defined at a top portion of vertical bottom wall (84). Central slot (78) is defined on each side by first outwardly angled wall (86), second inwardly angled wall (88), and third outwardly angled wall (90), wherein first and third angled walls (86, 90) are substantially parallel to one another. The pair of vertical bottom walls (84) of each central wall (76) are spaced apart from one another to define a portion of slot (92), which is substantially perpendicular to central slot (78). Each central wall (76) includes a resiliently biased portion between a top portion of second inwardly angled wall (88) and a bottom portion of third angled wall (90) of a central wall (76). A resiliently biased portion of one central wall (76) flexibly abuts against the resiliently biased portion of the other central wall (76) to form, for example, a spring clip. Thus, when one of wick pieces (29, 31) is received between a pair of central walls (76), second and third angled walls (88, 90) move away from one another to receive the respective wick piece (29, 31) into slot (92). After receiving the respective wick piece (29, 31), second and third angled walls (88, 90) then move toward one another to apply a retaining force against the respective wick piece (29, 31) disposed in slot (92). Slots (72, 78) are aligned to concurrently receive the other of the respective wick piece (29, 31). FIG. 7 shows wick pieces (29, 31) respectively received into slots (72, 78) and slot (92) of wick clip (38).

Wick clip (38) may comprise metal or plastic. For example, wick clip (38) may comprise a formable metal, such as stainless steel and/or aluminum, or an injection molded plastic. Alternatively, wick clip (38) may comprise any other suitable material. Wick clip (38) may be formed from a single material or a combination of materials. Wick clips are made by techniques known in the art for forming sheet metal, molding, or other forming processes.

Figure 17:
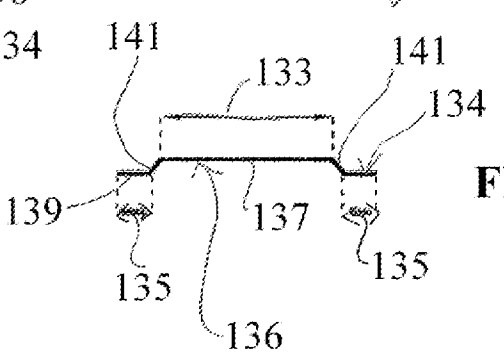
FIG. 17 depicts a side elevation view of the wick clip of FIG. 16.
Figure 16:
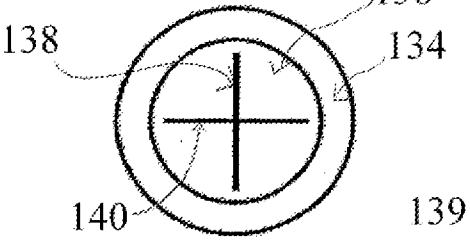
FIG. 16 depicts a top plan view of an alternative wick clip.
Figure 18:
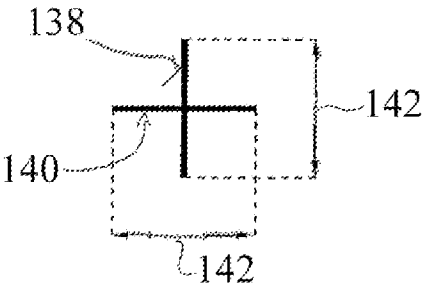
FIG. 18 depicts a fragmentary top plan view of the slots of the wick clip of FIG. 16.

FIGS. 16-18 show another embodiment of wick clip (132). Wick clip (132) operates in a manner similar to wick clip (38), as described further below with respect to wick clip (38). Wick clip (132) comprises an annular shape includes annular lower portion (134) and annular upper portion (136) disposed above and within the periphery of annular lower portion (134). Alternatively, either or both of annular lower portion (134) and annular upper portion (136) may comprise a non-annular shape as apparent to one of ordinary skill in the art in view of the teachings herein. Annular upper portion (136) has undersurface (137), which is disposed above undersurface (139) of annular lower portion (134). Undersurface (137) of annular upper portion (136) is attached to undersurface (139) of annular lower portion (134) via a connecting annular side wall (141). FIG. 17 shows annular upper portion (136) as having width (133). Annular lower portion (134) has width (135) extending from opposing ends of annular upper portion (136). As an example, width (133) may be 26 mm, and width (135) may be 5 mm. Other width measurements are possible as apparent to those of skill in the art in view of the teachings herein.

Slots (138, 140) are defined in a plus-shaped configuration that is disposed substantially centrally within annular upper portion (136). FIG. 18 shows slots (138, 140) as symmetric, with each of slots (138, 140) having a measureable width (142). Width (142) may be, for example, 22 mm. Alternatively, slots (138, 140) may have differing width measurements. Other width measurements for each of slots (138, 140) are possible as apparent to those of skill in the art in view of the teachings herein are possible.

Figure 4:
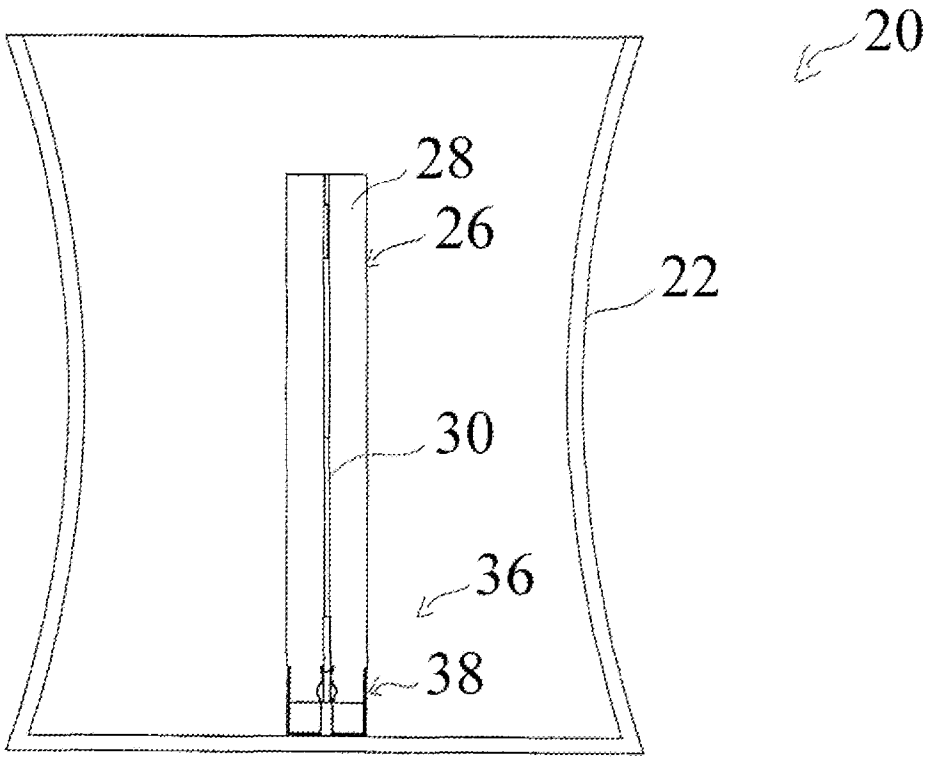
FIG. 4 depicts a side elevation view of the candle jar and candle wick of FIG. 1, where the candle wax is not shown and where a wick clip is shown.
Figure 5:
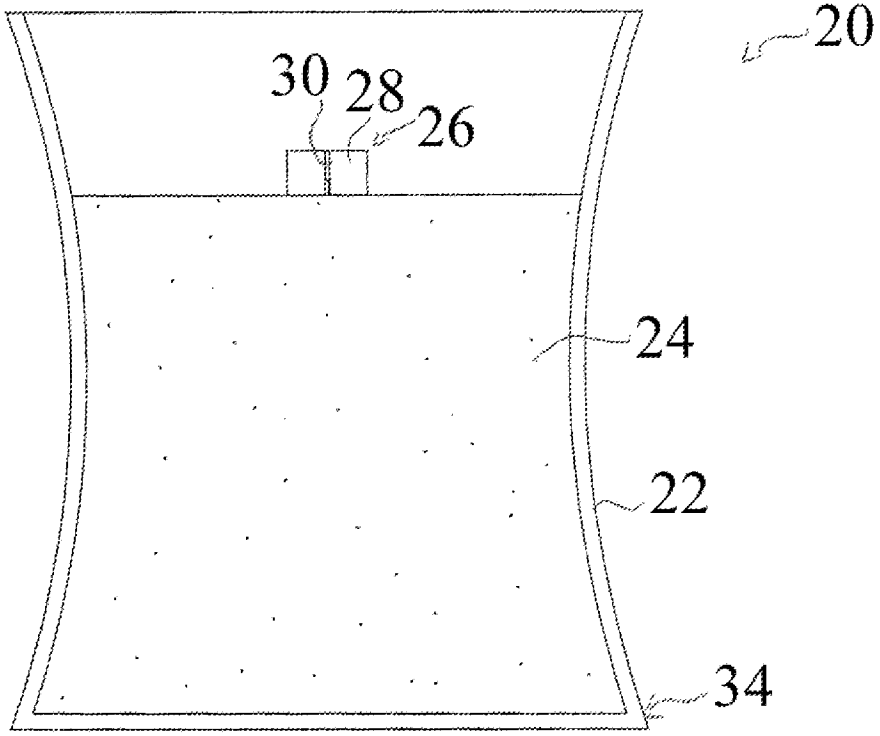
FIG. 5 depicts a side elevation view of the candle jar, candle wax, and candle wick of FIG. 1.

FIG. 4 shows a side elevation view of clip assembly (36) disposed in candle jar (22). Clip assembly (36) includes wick clip (38) and candle wick (26). Wick clip (38) engages and retains wick pieces (28, 30) of candle wick (26) such that candle wick (26) stands upright in a substantially vertical manner in candle jar (22) when wick clip (38) is secured within candle jar (22), as described below. Wick clip (38) is used as a centering device to maintain the unique cross configuration of wick pieces (28, 30) while candle wax (24) is poured into candle jar (22) during assembly and is cooled. After clip assembly (36) is formed as described below, wick clip (38) may be attached to upper surface (32) of bottom portion (34) of candle jar (22) via any suitable material for attachment, such as hot melt glue, epoxy, or other suitable adhesive, for example. FIG. 5 shows candle jar (22) filled with candle wax (24), which surrounds attached clip assembly (36) (FIG. 4).

Figure 15:
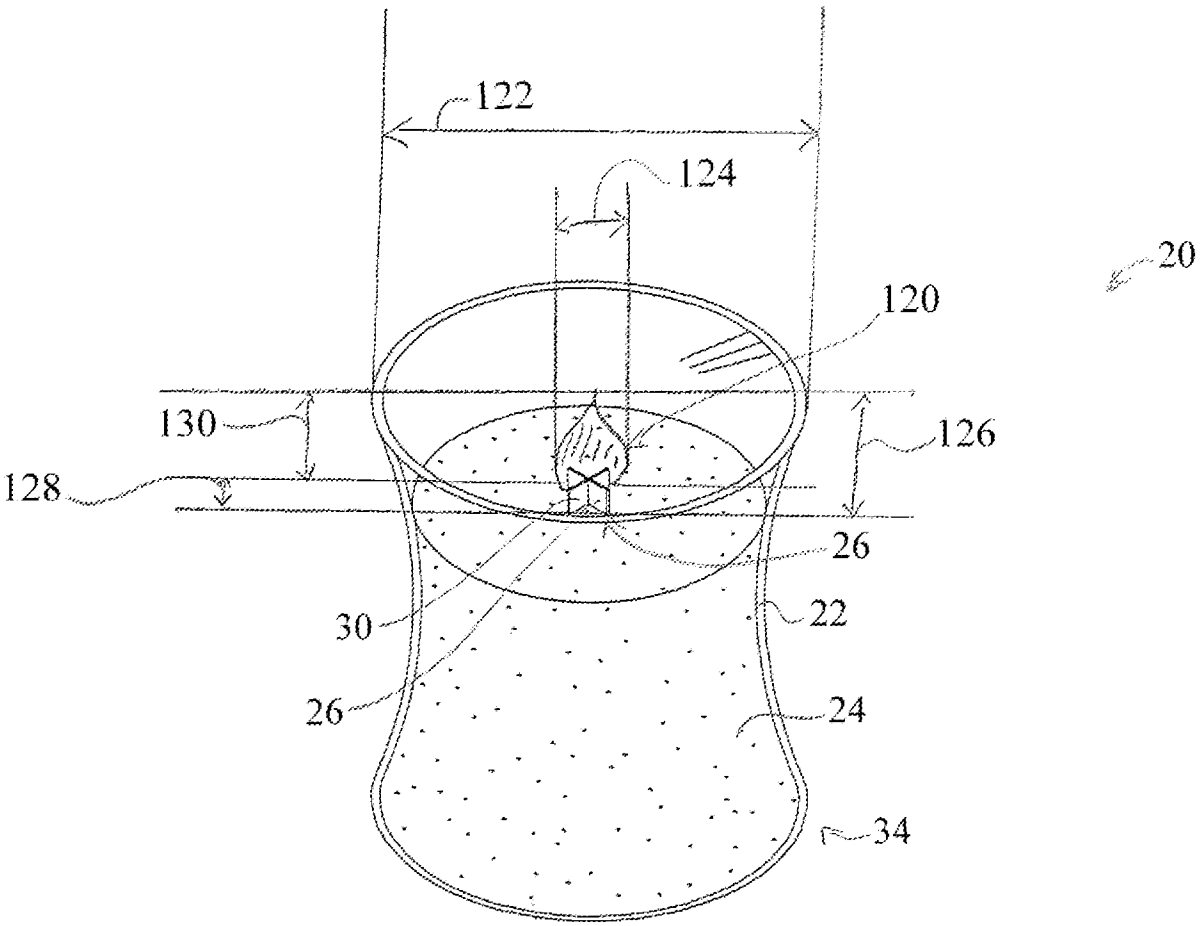
FIG. 15 depicts a perspective view of a flame burning on an exemplary candle wick.

FIG. 15 shows exemplary candle wick (26) of candle jar (22) lit with flame (120). Candle jar (22) includes width (122), and flame (120) includes width (124). As shown in FIG. 15, candle wick (26) advantageously provides a substantially round flame. First height (126) is the distance between a top portion of flame (120) and a portion of candle wick (26) that is disposed at a top portion of candle wax (24). Second height (128) is the distance between the bottom portion of flame (120) and the top portion of candle wax (24). Third height (130) is the distance between the top portion and the bottom portion of flame (120), indicating a flame height. First height (126) is the combination of second height (128) and third height (130).

Figure 8:
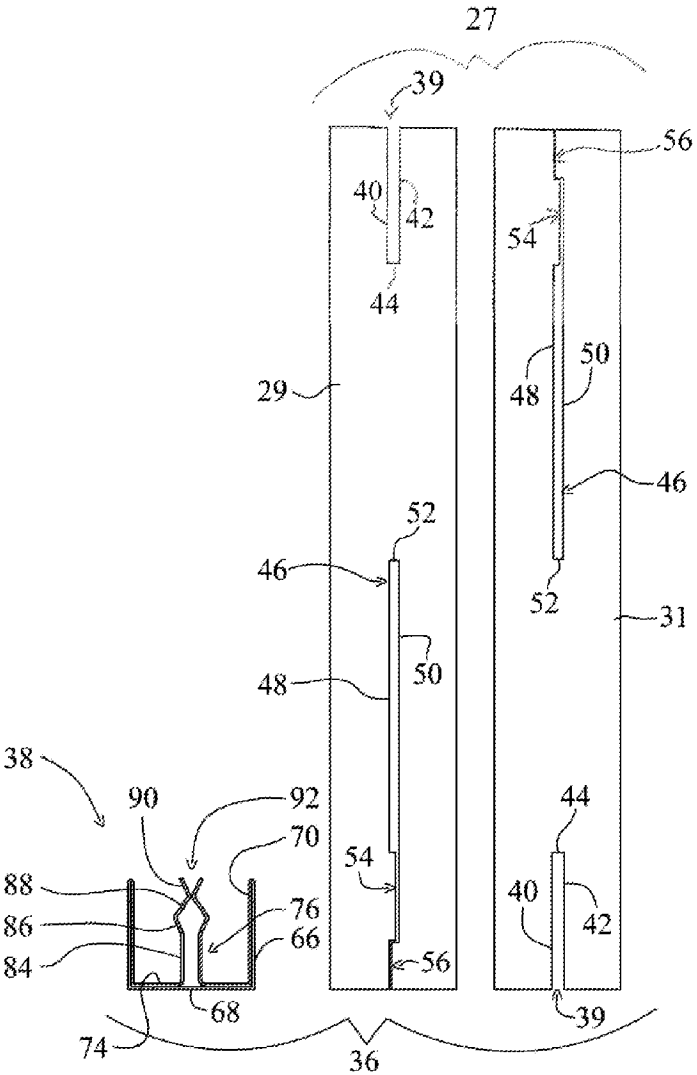
FIG. 8 depicts a side elevation view of the wick clip and candle wick of FIG. 6 before assembly.
Figure 9:
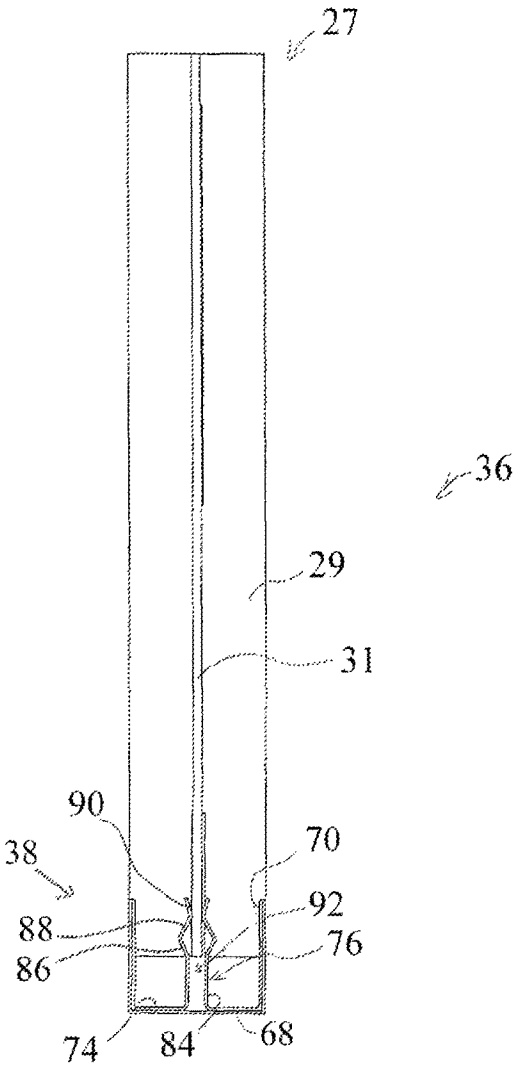
FIG. 9 depicts a side elevation view of the wick clip and candle wick of FIG. 6.
Figure 10:
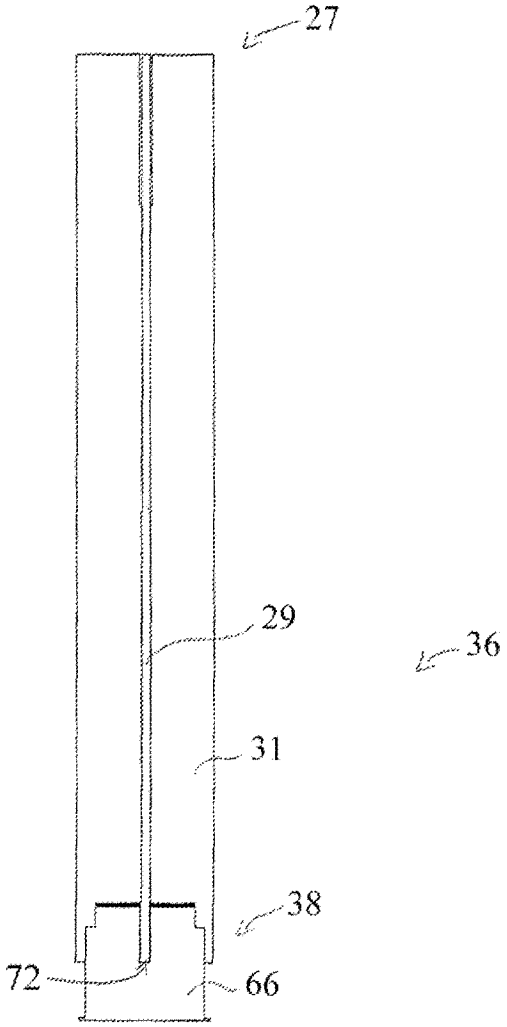
FIG. 10 depicts a front or rear elevation view of the wick clip and candle wick of FIG. 6.
Figure 11:
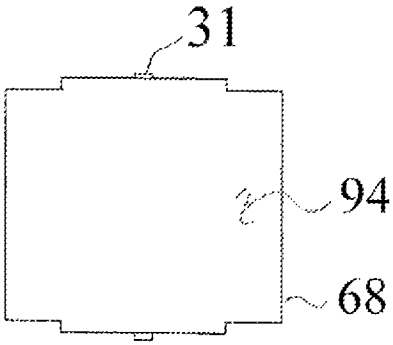
FIG. 11 depicts a bottom plan view of a wick clip of an embodiment of the present invention.
Figure 12:
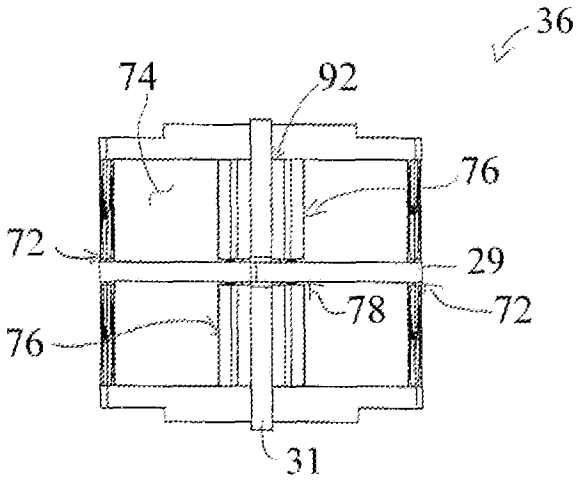
FIG. 12 depicts a top plan view of the wick clip and candle wick of FIG. 6.

FIG. 6 shows clip assembly (36), including wick clip (38) and candle wick (26), in a state in which wick clip (38) is not yet assembled to and is separate from wick pieces (28, 30) of candle wick (26). FIG. 8 shows a side elevation view of clip assembly (36) in a pre-assembled form, including wick pieces (29, 31) and wick clip (38). FIG. 9 shows a side elevation view of wick pieces (29, 31) received into wick clip (38) in a manner as described above. FIG. 10 shows a front or potentially rear elevation view of wick clip (38) with wick pieces (29, 31) received into wick clip (38) as described above. FIG. 11 shows a bottom plan view of clip assembly (36) in an assembled state and shows undersurface (94) of bottom horizontal wall (68) of wick clip (38). Undersurface (94) attaches to upper surface (32) of bottom portion (34) of candle jar (22) as described above. FIG. 12 shows a top plan view of clip assembly (36) in an assembled state after wick pieces (29, 31) and wick clip (38) are assembled in the manner described below.

Referring back to FIG. 6, to assemble clip assembly (36), a user first assembles wick pieces (29, 31) of candle wick (27) to one another. Wick pieces (29, 31) are positioned in a substantially perpendicular orientation with respect to one another. The portions of each wick piece (29, 31) including first slot (39) are positioned to face one another. Thus, first slot (39) of wick piece (29) is moved toward and received within first slot (39) of wick piece (31), such that protrusions (56) are pushed away from walls (48) on each respective wick piece (29, 31). While first slots (39) of wick pieces (29, 31) continue to advance toward one another, protrusions (54) are pushed away from walls (50) on each respective wick piece (29, 31). This allows for the other wick piece (29, 31) to advance past protrusion (54) of the opposite wick piece (29, 31). Once protrusions (56) of each wick piece (29, 31) are advanced past each other and past protrusion (54) of the opposing wick piece (29, 31), protrusions (56) are received within an elongate portion of the receiving slot (46) that defines a wider space. Protrusions (56) continue to advance until opposing connecting walls (52) of each wick piece (29, 31) abut and provide a stop against one another. At this point, protrusions (54, 56) of one of wick pieces (29, 31) are received in a snap-fit connection into first slot (39)

of the other of wick pieces (29, 31), further retaining wick pieces (29, 31) to one another.

In particular, protrusions (54, 56) include exterior walls that are disposed on opposing faces of each of wick pieces (29, 31). A set of protrusions (54, 56) of one of wick pieces (29, 31) is received in first slot (39) of the other of wick pieces (29, 31) such that the exterior walls of protrusions (54, 56) abut elongate walls (40, 42) of first slot (39). Further, the wider space defined by portions of elongate walls (48, 50) of second slot (46) of one of wick pieces (29, 31) engage portions of the opposing faces of the other of wick pieces (29, 31).

At this point, as shown in FIG. 7, engaged wick pieces (29, 31) of candle wick (27) form a plus-shaped configuration. Either end of engaged wick pieces (29, 31) of candle wick (27) may then be oriented for reception within wick clip (38). As shown in FIG. 7, wick piece (31) is received in slot (92) of wick clip (38), and wick piece (29) is received in slots (72, 78) of wick clip (38). A designated bottom portion of wick piece (29) is slidingly received into slots (72, 78) while a designated bottom portion of wick piece (31) is concurrently slidingly received into slot (92). As described above, when wick piece (31) downwardly advances past second and third angled walls (88, 90), walls (88, 90) are pushed away from each other to receive wick piece (31). Walls (88, 90) attempt to move back toward another and, as such, apply a retaining force against received wick piece (31). Engaged wick pieces (29, 31) are pressed down until a bottom portion of wick piece (29) encounters and is stopped against wall (82) of slot (72). At this point, candle wick (27) is removably and securely retained in wick clip (38) to create clip assembly (36).

Figure 13:
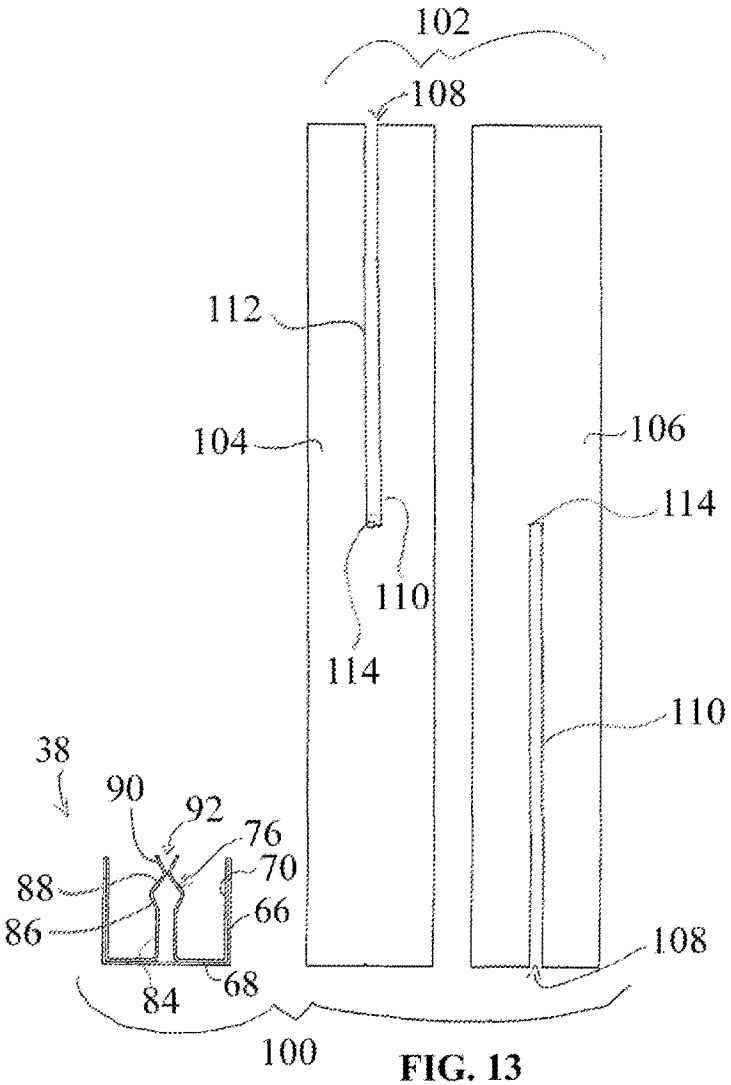
FIG. 13 depicts a side elevation view of an alternative embodiment of a candle wick and wick clip assembly prior to assembly.
Figure 14:
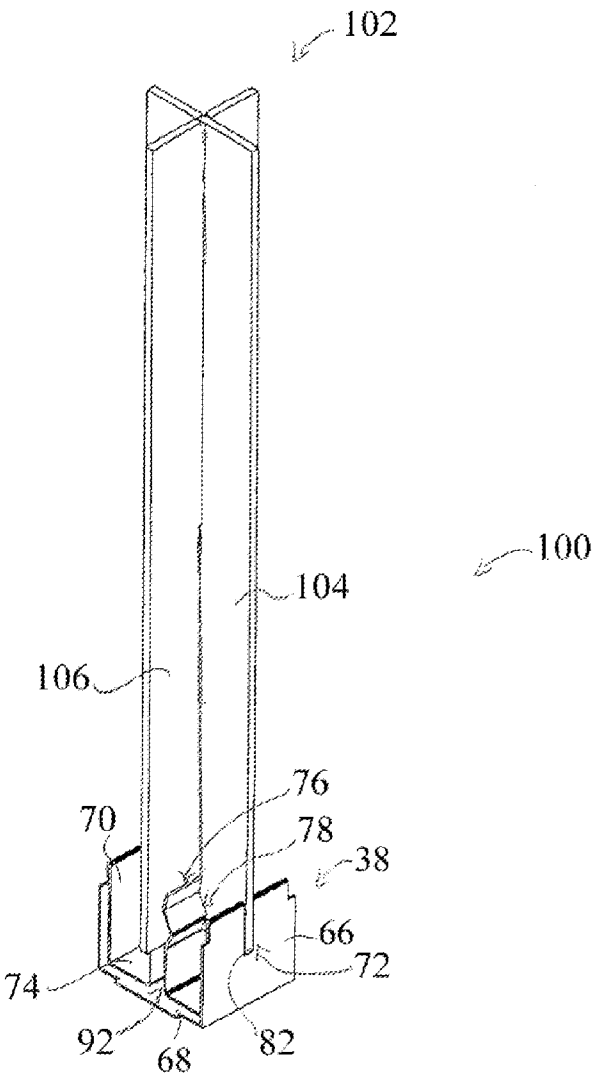
FIG. 14 depicts a perspective view of the wick clip and candle wick of FIG. 13.

FIG. 13 shows another exemplary clip assembly having a different candle wick configuration and the same wick clip as described above with respect to FIG. 6. For example, FIG. 13 shows exemplary clip assembly (100) including candle wick (102) and wick clip (38), which is the same wick clip (38) described above with respect to clip assembly (36). Candle wick (102) includes wick pieces (104, 106). Each wick piece (104, 106) includes a slot (108) defined by elongate walls (110, 112) and a connecting wall (114) disposed therebetween. Wick pieces (104, 106) are assembled to one another to achieve a form shown in FIG. 7 with respect to wick pieces (29, 31), such that wick pieces (104, 106) are also oriented in a substantially perpendicular position with respect to one another. To assemble wick pieces (104, 106) to one another, end portions of each respective wick piece (104, 106) that include slot (108) are positioned toward one another. Slots (108) of opposing wick pieces (104, 106) are advanced toward and received within each other until opposing connecting walls (114) abut one another, providing a stop for each of wick pieces (104, 106) from advancing further. Walls (110, 112) of one of wick pieces (104, 106) receive opposing faces of the other of wick pieces (104, 106). At this point, end portions of wick pieces (104, 106) are substantially aligned and configured for receipt within slots (72, 78) and slot (92) of wick clip (38) in a manner describe above with respect to clip assembly (36). In the present example, as shown in FIG. 14, wick piece (106) is received within slot (92), and wick piece (104) is received within slots (72, 78) (FIG. 6).

EXAMPLES

The candle wicks described in the examples below were tested in a laboratory. A measurement of flame height was taken from each candle wick of each candle of different candle test batches. The tested candle wicks and candles were burned in four hour intervals twice a day. Each measurement was recorded for each candle the same amount of time into a four hour burning period on each day. Identical qualities of each type of wood were used for each test batch. For example, each tested candle wick was formed from the same material and had the same configuration and size. Further, identical fragrances and glass were used for each tested candle of each test batch. Each tested wooden candle wick piece had a thickness of 0.030±0.0025 inches and was made from one of pine, cherry, maple, and southern maple. Candles were tested in 10 ounce glass jars, and a Noel fragrance and a Cinnamon Chai fragrance was tested within each of the examples below (as set forth in the tables below).

For each of the examples below, batches of 6 candles were burned during the above-referenced four hour intervals twice a day, with measurements of the flame height of each candle taken during each burning session until the end of the candle's life. Flame height was measured in inches. Testing procedures followed those set forth by ASTM International of West Conshohocken, Pa. in ASTM their Designation F 2417-09 publication, in particularly within Section 5: Test Methods.

ASTM standards, as generally known to those of ordinary skill in the art, provide a maximum desired flame height of three inches such that a reading of above three inches of flame height indicates a failure. A desired minimum flame height is considered a quarter of an inch, such that any reading below a quarter of an inch is deemed a failure. Thus, an acceptable flame height is above a quarter of an inch and below three inches.

Example 1

TABLE 1 shows the measurements taken for flame height after each reading for each tested candle during the testing period for candles having the exemplary two-piece wooden candle wick of FIG. 1. The candles were produced during a production run and sent to a separate laboratory for testing.

TABLE 1

| Flame Height Measurements | | | | | | | | | |
|---|---|---|---|---|---|---|---|---|---|
| Made in Production <¼" | ¼ to 1" | 1 to 2" | 2 to 3" | over 3" | Total | Candles | Batch | Wood Type | Fragrance |
| 0 | 60 | 39 | 3 | 0 | 102 | 6 | PW1 | Maple | Noel |
| 7 | 111 | 19 | 0 | 0 | 137 | 6 | PW2 | Cherry | Noel |
| 1 | 55 | 41 | 0 | 0 | 97 | 6 | PW3 | Pine | Noel |
| 15 | 68 | 33 | 1 | 0 | 117 | 6 | PW4 | S. Maple | Noel |
| 2 | 13 | 61 | 6 | 0 | 82 | 6 | PW5 | S. Maple | Cinnamon Chai |

TABLE 1-continued

| | Flame Height Measurements | | | | | | | | | |
|---|---|---|---|---|---|---|---|---|---|---|
| | Made in Production <¼" | ¼ to 1" | 1 to 2" | 2 to 3" | over 3" | Total | Candles | Batch | Wood Type | Fragrance |
| | 3 | 57 | 27 | 1 | 0 | 88 | 6 | PW6 | Pine | Cinnamon Chai |
| | 2 | 38 | 64 | 0 | 0 | 104 | 6 | PW7 | Cherry | Cinnamon Chai |
| F | 0 | 7 | 57 | 10 | 3 | 77 | 6 | PW8 | Maple | Cinnamon Chai |
| Total | 30 | 409 | 341 | 21 | 3 | 804 | 48 | | | |
| % | 3.7% | 50.9% | 42.4% | 2.6% | 0.4% | 100.0% | | | | |

Only Batch PW8 had flame height failure per ASTM standards. However, each of Batches PW2-PW7 had minimum flame height failures. The combined total of minimum and maximum flame height failures was 4.1%, while the combined total of passable flame heights was 95.9%.

Comparative Example 2

TABLE 2 shows the measurements taken for flame height after each reading for each tested candle during the testing period for candles including a flat one-piece wooden candle wick, which is referred to as a comparative example in TABLE 2 below. The flat wick candles were made in a laboratory with an optimized design to each have an expected acceptable flame height of above a quarter of an inch and below three inches, such that the tested one-piece candle wick candles were expected to be as good as or better than the two-piece candle wick candles. The comparative example candles were also tested in a laboratory.

TABLE 2

| | Comparative Example Flame Height Measurements | | | | | | | | | |
|---|---|---|---|---|---|---|---|---|---|---|
| | Comparative Example | | | | | | | | | |
| | Made in Lab <¼" | ¼ to 1" | 1 to 2" | 2 to 3" | over 3" | Total | Candles | Batch | Wood Type | Fragrance |
| | 38 | 96 | 7 | 0 | 0 | 141 | 6 | WW1 | Pine | Noel |
| | 10 | 142 | 11 | 1 | 0 | 164 | 6 | WW2 | Cherry | Cinnamon Chai |
| F | 6 | 50 | 30 | 3 | 10 | 99 | 6 | WW3 | Maple | Cinnamon Chai |
| | 54 | 101 | 17 | 0 | 0 | 172 | 6 | WW4 | Cherry | Noel |
| | 45 | 83 | 15 | 0 | 0 | 143 | 6 | WW5 | Maple | Noel |
| | 86 | 57 | 4 | 0 | 0 | 147 | 6 | WW6 | S. Maple | Cinnamon Chai |
| | 31 | 85 | 6 | 0 | 0 | 122 | 6 | WW7 | Pine | Cinnamon Chai |
| | 110 | 47 | 0 | 0 | 0 | 157 | 6 | WW8 | S. Maple | Noel |
| Total | 380 | 661 | 90 | 4 | 10 | 1145 | 48 | | | |
| % | 33.2% | 57.7% | 7.9% | 0.3% | 0.9% | 100.0% | | | | |

Only Batch WW3 had flame height failure per ASTM standards. However, each of Batches WW1-PW8 had minimum flame height failures. The combined total of minimum and maximum flame height failures was 34.1%, while the combined total of passable flame heights was 65.9%.

Thus, as the two-piece candle wick candles had a 95.9% flame height pass rate and the comparative example candles had a 65.9% flame height pass rate, the two-piece candle wick candles showed a surprising improvement of 45.4% in a flame height pass rate over the comparative example candles. Stated another way, the two-piece candle wick candles had a 4.1% failure rate whereas comparative example candles had a 34.1% failure rate. Thus, the comparative example candles surprisingly failed at a rate of 8.3 times more often than the two-piece candle wick candles.

While a configuration of two pieces of wood disposed in parallel and adjacently touching was found to not substantially improve performance on the flame height test to produce an optimal flame height, a plus-shaped wick configuration was found to produce the surprising results described above in Example 1. The results show a substantial improvement in which a near 96% pass rate was observed for plus-shaped candle wick candles achieving optimal flame height range, and a more consistent rounding of the flame was observed for those candles as well. Thus, Example 1 shows a surprising improvement in burn performance and more consistent heat distribution for the plus-shaped candle wick candles.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, the examples, embodiments, geometries, materials, dimensions, ratios, steps, and the like discussed above are illustrative. Accordingly, the scope of the present invention should be considered in terms of the following claims and is understood not to be limited to the details of structure and operation shown and described in the specification and drawings.

We claim:

1. A wick clip, comprising:

a base end and a receiving end, wherein the wick clip is configured to receive a candle wick in a direction from its receiving end to its base end;

a plurality of walls each having a longitudinal axis, wherein the longitudinal axis of every wall of the plurality of walls is defined at the base end of the wick clip and is generally parallel with the longitudinal axis of every other wall of the plurality of walls, wherein the plurality of walls comprises a pair of exterior walls and a pair of central walls positioned between the pair of exterior walls;

wherein each of the plurality of walls comprises a slit, wherein all the slits are aligned with one another and collectively form a first slot that is configured to receive a first portion of the candle wick, wherein the pair of central walls form a second slot that is perpendicular to the first slot and configured to receive a second portion of the candle wick, wherein each wall of the pair of central walls are resiliently biased against one another thereby enabling the pair of central walls to clamp against the second portion of the candle wick once one the second portion of the candle wick is received in the second slot, and wherein the first slot and second slot collectively form a plus-shaped configuration that is configured to receive and hold a plus-shaped candle wick configuration that is formed by the first portion and the second portion of the candle wick.

2. The wick clip of claim 1, wherein the wick clip comprises a material selected from a group consisting of metal and plastic.

3. The wick clip of claim 1, wherein the wick clip comprises a generally planar and solid undersurface disposed below the first and second slots.

4. A clip assembly, comprising:

(a) a candle wick having sufficient capillary action to deliver fuel to a flame, wherein upon lighting the candle wick, a flame having a flame height less than or equal to about 3 inches from the a top of the candle wick is created, said candle wick comprising a first portion and a second portion, wherein each portion comprises:

(i) a length, wherein the first portion is oriented perpendicular to the second portion to form a plus-shaped candle wick configuration; and (b) a wick clip comprising:

a base end and a receiving end, wherein the wick clip is configured to receive a candle wick in a direction from its receiving end to its base end;

a plurality of walls each having a longitudinal axis, wherein the longitudinal axis of every wall of the plurality of walls is defined at the base end of the wick clip and is generally parallel with the longitudinal axis of every other wall of the plurality of walls, wherein the plurality of walls comprises a pair of exterior walls and a pair of central walls positioned between the pair of exterior walls;

wherein each of the plurality of walls comprises a slit, wherein all the slits are aligned with one another and collectively form a first slot that is configured to receive a first portion of the candle wick, wherein the pair of central walls form a second slot that is perpendicular to the first slot and configured to receive a second portion of the candle wick, wherein each wall of the pair of central walls are resiliently biased against one another thereby enabling the pair of central walls to clamp against the second portion of the candle wick once one the second portion of the candle wick is received in the second slot, and wherein the first slot and second slot collectively form a plus-shaped configuration that is configured to receive and hold a plus-shaped candle wick configuration that is formed by the first portion and the second portion of the candle wick; and wherein the plus-shaped candle wick configuration of the candle wick is inserted into the plus-shaped configuration of the wick clip which thereby forms the clip assembly.

5. A candle assembly, comprising:

(a) a candle wick having sufficient capillary action to deliver fuel to a flame, wherein upon lighting the candle wick, a flame having a flame height less than or equal to about 3 inches from the a top of the candle wick is created, said candle wick comprising a first portion and a second portion, wherein each portion comprises:

(i) a length, wherein the first portion is oriented perpendicular to the second portion to form a plus-shaped candle wick configuration; and (b) a wick clip comprising:

a base end and a receiving end, wherein the wick clip is configured to receive a candle wick in a direction from its receiving end to its base end;

a plurality of walls each having a longitudinal axis, wherein the longitudinal axis of every wall of the plurality of walls is defined at the base end of the wick clip and is generally parallel with the longitudinal axis of every other wall of the plurality of walls, wherein the plurality of walls comprises a pair of exterior walls and a pair of central walls positioned between the pair of exterior walls;

wherein each of the plurality of walls comprises a slit, wherein all the slits are aligned with one another and collectively form a first slot that is configured to receive a first portion of the candle wick, wherein the pair of central walls form a second slot that is perpendicular to the first slot and configured to receive a second portion of the candle wick, wherein each wall of the pair of central walls are resiliently biased against one another thereby enabling the pair of central walls to clamp against the second portion of the candle wick once one the second portion of the candle wick is received in the second slot, and wherein the first slot and second slot collectively form a plus-shaped configuration that is configured to receive and hold a plus-shaped candle wick configuration that is formed by the first portion and the second portion of the candle wick; and (c) a container, the container configured to securely receive the wick clip;

wherein the plus-shaped candle wick configuration of the candle wick is inserted into the plus-shaped configuration of the wick clip which thereby forms a clip assembly; and wherein the clip assembly is inserted into the container which thereby forms the candle assembly.

6. The candle assembly of claim 5, wherein the container is configured to receive wax.

7. The candle assembly of claim 5, wherein at least one of the first portion or the second portion comprises a material selected from a group consisting of wood, cardboard, and braided glass.

8. The candle assembly of claim 5, wherein at least one of the first portion or the second portion comprises a material selected from a group consisting of pine, southern maple, maple, and cherry.

* * * * *